United States Patent [19]

Collin

[11] 4,422,641

[45] Dec. 27, 1983

[54] SHIFTABLE BLOCK PUZZLE

[76] Inventor: Pierre K. Collin, 1077 B St-Joseph Blvd., Charlesbourg West, Quebec, Canada, G2K 1G3

[21] Appl. No.: 359,430

[22] Filed: Mar. 18, 1982

[51] Int. Cl.[3] ..... A63F 9/08

[52] U.S. Cl. ..... 273/153 S

[58] Field of Search ..... 273/153 S

[56] References Cited

U.S. PATENT DOCUMENTS 207,124 8/1878 Kinsey ..... 273/153 S X
442,445 12/1890 Lurtey ..... 273/153 S

FOREIGN PATENT DOCUMENTS 741696 8/1966 Canada ..... 273/153 S
245004 12/1925 United Kingdom ..... 273/153 S
403280 12/1933 United Kingdom ..... 273/153 S
592536 9/1947 United Kingdom ..... 273/153 S

*Primary Examiner*—Anton O. Oechsle
*Attorney, Agent, or Firm*—Oblon, Fisher, Spivak, McClelland & Maier

[57] ABSTRACT

A shiftable block puzzle comprising a board defining a bottom wall having a flat top surface. A plurality of blocks of different sizes are confined for lateral movement on the flat surface. A restricted area is defined on the flat top surface for reception thereon of a single primary one of the blocks after shifting movements of secondary ones of the blocks to make way for displacement of the primary block from a predetermined starting position. The primary block is adapted to permit same to be displaced onto said restricted area.

11 Claims, 6 Drawing Figures

SHIFTABLE BLOCK PUZZLE

BACKGROUND OF INVENTION (a) Field of Invention

The present invention relates to a shiftable block puzzle wherein a plurality of blocks are confined for lateral movement on a flat board surface and wherein a primary one of the blocks is shiftable, after displacement of secondary ones of the blocks, from a predetermined starting position to a restricted area on the flat top surface and is specifically adapted to be received in the restricted area while the secondary blocks are prevented from entry thereon.

(b) Description of Prior Art

A game of this type is known as described in Canadian Pat. No. 741,696 issued on Aug. 30, 1966. The present invention relates to an improvement of such game board and blocks.

SUMMARY OF INVENTION

It is a feature of the present invention to provide an improved shiftable block puzzle wherein the blocks are confined for lateral movement on a game board flat surface which defines a restricted area permitting only a primary one of the blocks to be movable thereon while preventing the other blocks from being moved thereon. The primary one of the blocks is provided with a means to permit same to be displaced on the restricted area.

Another feature of the present invention is to provide a shiftable block puzzle comprising a plurality of blocks which are attached in a flat top surface of the game board and which are shiftably displaced on the surface.

According to the above features, from a board aspect, the present invention provides a shiftable block puzzle comprising a board defining a bottom wall having a flat top surface. A plurality of blocks of different sizes are confined for lateral movement on the flat surface. A restricted area is defined on this flat top surface for reception thereon of a single primary one of the blocks after shifting movements of secondary ones of the blocks to make way for displacement of the primary block from the predetermined starting position. The primary block is provided with means to permit same to be displaced onto the restricted area.

BRIEF DESCRIPTION OF DRAWINGS

A preferred embodiment of the present invention will now be described with reference to the examples thereof as illustrated by the accompanying drawings in which.

DESCRIPTION OF PREFERRED EMBODIMENTS

Figure 1:
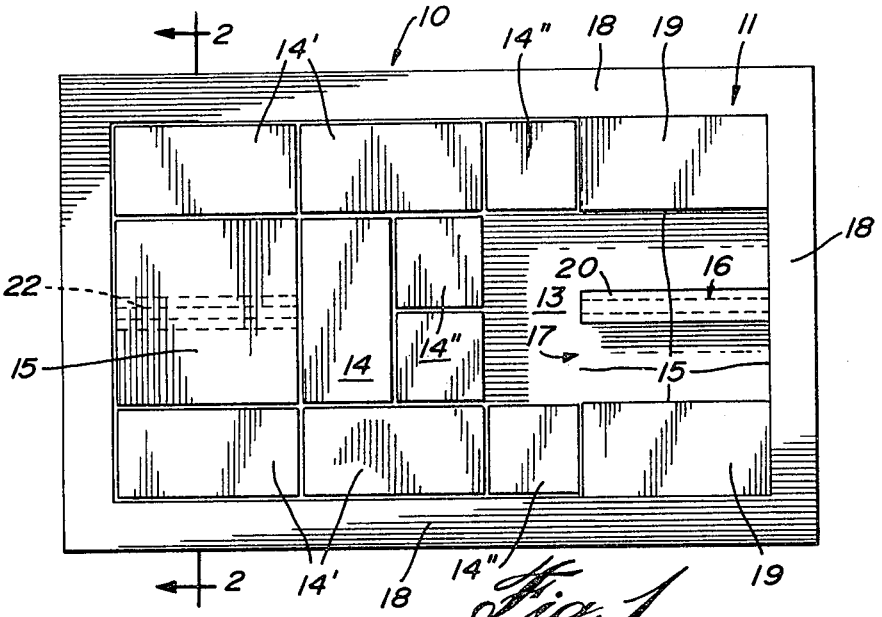
FIG. 1 is a plan view of the shiftable block puzzle.
Figure 2:
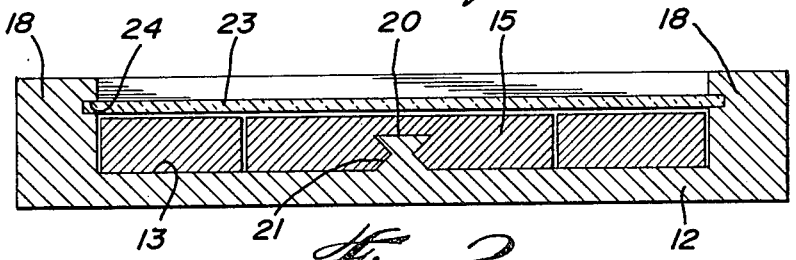
FIG. 2 is a cross-section view along cross-section lines II—II of FIG. 1 and showing a cover provided on the board.

Referring now to the drawings, and more particularly to FIGS. 1 and 2, there is shown generally at 10 the shiftable block puzzle of the present invention. The puzzle comprises a game board 11 defining a bottom wall 12 having a flat top surface 13. A plurality of blocks 14 of different sizes are confined for lateral movement on the flat top surface 13. A restricted area 15 is defined on the flat top surface 13 and is of such a size for reception thereon of a single primary one of the blocks 14, this primary block being designated by reference numeral 15.

The remaining blocks 14 are defined as secondary blocks and there are nine of these. Five of the secondary blocks herein designated by reference numeral 14' have a rectangular shape and are each half the size of the primary block 15 which is of a square contour. The four remaining secondary blocks 14'' are square blocks which are half the size of the rectangular blocks 14'. All of the blocks are flat blocks of identical thickness.

The object of the game is to displace the primary block 15, from a predetermined starting position as shown in FIG. 1, by shifting movement of the secondary blocks 14 to make way for the primary block 15 to be displaced from its starting position to displace same onto the restricted area 15.

The restricted area 15 is provided with obstruction means 16 at the entrance 17 of the restricted area to prevent the secondary blocks to enter the restricted area. As shown in FIG. 1 the game board is provided with side walls 18 about its periphery to confine the blocks 14 and 15 on the top surface 13. Immovable blocks 19 are secured to the top surface 13 to define the zone 15. The distance of the restricted area between the obstruction means and the blocks 19 is smaller than the width of any of the secondary blocks thereby preventing them from entering the restricted area.

As shown in FIG. 1, the obstruction means 16 is defined by an elongated protruding element extending above the bottom wall 13 and has a enlarged triangular shaped cross-section head 20 and an outwardly tapering neck portion 21. The obstruction means 16 is disposed centrally along the restricted area. The primary rectangular block 15 is provided with a bottom slot centrally disposed thereacross and shaped to receive the elongated obstruction means 16 therein whereby the block 15 can be positioned over the restricted area by sliding displacement thereover with said obstruction means entering the slot 22 which is shaped, as shown in FIG. 2, to receive the obstruction means therein.

As shown in FIG. 2, a cover member 23 may be provided to retain the blocks on the flat top surface 13 when the blocks are not attached. This cover member is a flat board slidable in opposed grooves 24 provided in opposed elongated side walls 18 of the game board.

Figure 3:
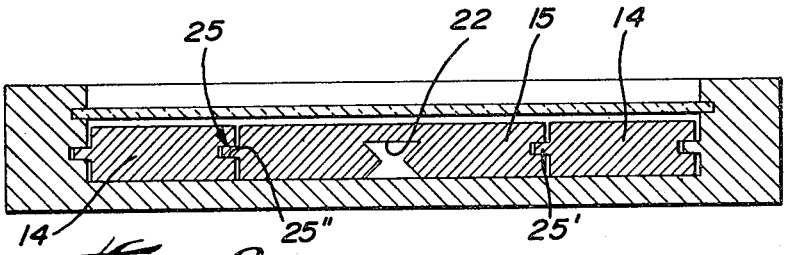
FIG. 3 is the same view as FIG. 2 but modified to show the blocks provided with an example of the attachment means.

As shown in FIG. 3, the blocks 15 and 14 are provided with attachment means 25 herein constituted by a tongue and groove coupling between the blocks and the side walls 18 of the game board. Two adjoining side walls of each block are provided with a tongue 25' whilst the other two adjoining sides are provided with a groove 25'' whereby each of the blocks are attached to each other but are shiftable over the top surface 13. In order to shift the blocks a free area is provided on the top surface and it is dimensioned as shown by the area bounding the secondary square blocks 14" and the entrance of the restricted area 15.

Figure 4:
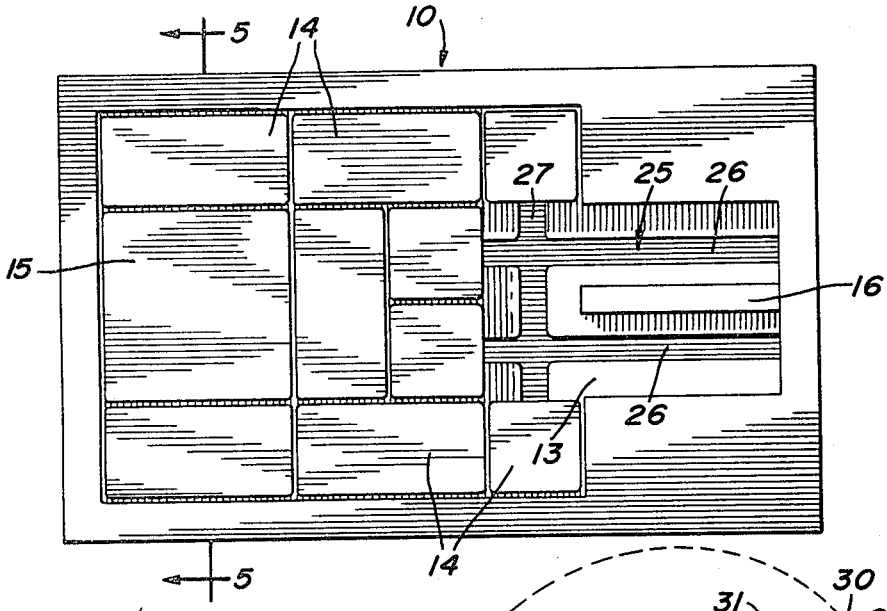
FIG. 4 is a plan view of another example of the construction of the shiftable block puzzle showing another form of attachment means.
Figure 5:
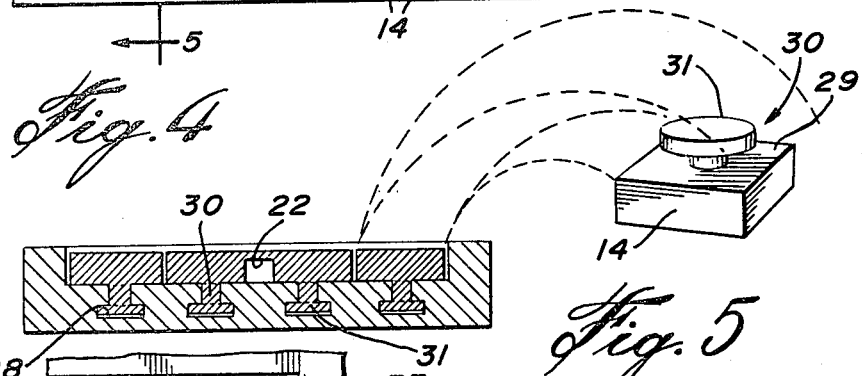
FIG. 5 is a cross-section view along cross-section lines V—V of FIG. 4 and showing the construction of the attachment posts secured to one of the blocks.

Referring now to FIGS. 4 and 5, there is shown a still further embodiment of the attachment means 25. As herein shown the attachment means is defined by transverse slots 26 and 27 disposed across the flat surface 13 of the board with the lower end of the slots terminating in an enlargement portion 28. The blocks 14 and 15 are each provided on their flat bottom wall 29 (see FIG. 5) with an attachment post which protrudes above their lower surface 29 and terminates in an attachment head 31 which is receivable in the enlargement portion 28 of the slots 26 and 27 whereby to be captive therein whilst permitting sliding displacement of the blocks along the slots or grooves 26 and 27.

Figure 6:
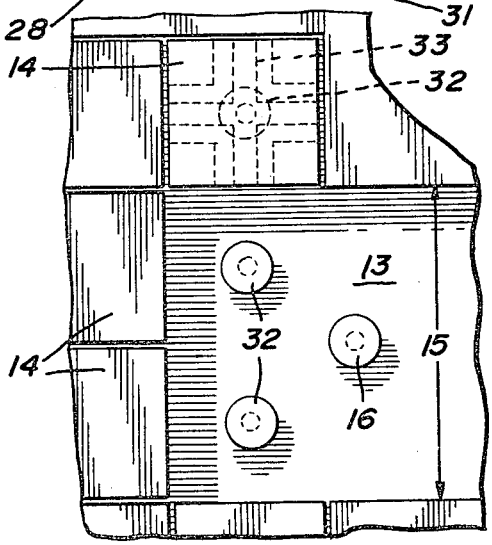
FIG. 6 is a fragmented plan view of the game board showing another alternative of the attachment means.

Referring now to FIG. 6, there is shown other alternatives of the attachment means. As herein shown the attachment means is provided by a plurality of posts 32 and shaped to retain the blocks 14 and 15 over the top surface 13 and may be shaped similarly to the attachment post 30 of the embodiment as shown in FIG. 5 but protruding above the flat top surface 13. The blocks 14 are provided with transverse grooves 33 which would be shaped to receive the post 32 in sliding fit therein. The obstruction means 16 may also be constituted by a single post, similarly shaped as the post 32 and disposed centrally at the entrance of the restricted area 15.

It is within the ambit of the present invention to cover any obvious modifications of the preferred embodiment described herein, provided such modifications fall within the scope of the appended claims.

I claim:

1. A shiftable block puzzle comprising a board defining a bottom wall having a flat top surface, a plurality of blocks of different sizes confined for lateral movement on said flat surface, and a restricted area on said flat top surface for reception thereon of a single primary one of said blocks after shifting movements of secondary ones of said blocks to make way for displacement of said primary block from a predetermined starting position, said primary block having means to permit same to be displaced onto said restricted area, said restricted area provided with a protruding element extending above said flat bottom wall and located to prevent said secondary blocks to enter said restricted area, said means to permit said primary block to be displaced into said restricted area being a slot in a lower surface thereof for reception therein of said protruding element to permit said primary block to be shifted into said restricted area.

2. A shiftable block puzzle as claimed in claim 1 wherein said primary one of said blocks is larger than said secondary blocks.

3. A shiftable block puzzle as claimed in claim 2 wherein said blocks are of flat rectangular shape.

4. A shiftable block puzzle as claimed in claim 3 wherein said primary one of said blocks is of square contour, said secondary blocks being of smaller rectangular and square contour.

5. A shiftable block puzzle as claimed in claim 4 wherein there are nine secondary blocks, five of said secondary blocks having a rectangular contour and each being half the size of said square contoured primary block, and four of said secondary blocks being of square contour and each being half the size of said rectangular contoured secondary blocks.

6. A shiftable block puzzle as claimed in claim 3 wherein said blocks are provided with attachment means whereby they are shiftably attached to said flat bottom wall and movable along transverse axes, said attachment means confining said blocks over said bottom wall.

7. A shiftable block puzzle as claimed in claim 6 wherein said attachment means is a transverse slot across a lower surface of each said blocks and a plurality of attachment posts protruding over said flat bottom wall equidistantly spaced along said transverse axes, said posts having a retention head receivable in a like retention groove at a bottom end of said slot of said blocks.

8. A shiftable block puzzle as claimed in claim 7 wherein said attachment means is constituted by a plurality of transverse slots disposed in said flat bottom wall, said slots having retention grooves therein, and said blocks having an attachment post in a lower face thereof for sliding engagement in said slots.

9. A shiftable block puzzle as claimed in claim 3 wherein said board is of rectangular shape and further comprises peripheral side walls.

10. A shiftable block puzzle as claimed in claim 9 wherein a cover is removably secured over said blocks and engaged by said side walls.

11. A shiftable block puzzle as claimed in claim 1 wherein a block shifting area is defined adjacent said restricted area, said primary block being positionable to a starting position which is forwardmost of said restricted area with said secondary blocks being positioned to each side of said primary block and intermediate said primary block and said restricted area, and a free area over said block shifting area to permit said shifting movement of said blocks.

* * * * *

UNITED STATES PATENT AND TRADEMARK OFFICE

CERTIFICATE OF CORRECTION

PATENT NO. : 4,422,641

DATED : December 27, 1983

INVENTOR(S) : Pierre R. Collin

It is certified that error appears in the above-identified patent and that said Letters Patent is hereby corrected as shown below:

On the title page, Item /76/ Inventor: "Pierre K. Collin" should read -- Pierre R. Collin --.

Signed and Sealed this

*Sixteenth* Day of *April 1985*

[SEAL]

*Attest:*

DONALD J. QUIGG

*Attesting Officer* *Acting Commissioner of Patents and Trademarks*